United States Patent [19]

Douglas, Sr.

[11] 4,014,374

[45] Mar. 29, 1977

[54] ANTI-THEFT CARRYING BAG

[76] Inventor: Aubrey Franklin Douglas, Sr., Rte. 1, Box 182B2, Petersburg, Va. 23803

[22] Filed: May 17, 1976

[21] Appl. No.: 687,254

[52] U.S. Cl. ..... 150/33

[51] Int. Cl.[2] ..... A45C 3/06; A45C 13/18

[58] Field of Search ..... 150/33, 47; 190/57, 190/58 B; 16/110, 110.5, 115, 125; 224/45 P, 46 R

[56] References Cited

UNITED STATES PATENTS

| | | | |
|---|---|---|---|
| 539,842 | 5/1895 | Wilfert | 150/47 |
| 2,783,926 | 3/1957 | Wise | 150/47 X |
| 2,908,306 | 10/1959 | Chorost | 150/47 |
| 3,126,598 | 3/1964 | Gottschalk | 150/47 X |
| 3,744,132 | 7/1973 | Korth | 150/47 X |

*Primary Examiner*—Donald F. Norton
*Attorney, Agent, or Firm*—Norman B. Rainer

[57] ABSTRACT

A carrying bag consisting of a carrying means such as a handle or strap member attached to a container member is provided with an anti-theft device associated with said carrying means. In operation, the anti-theft device rapidly deploys a line connecting the container member to the carrying means, thereby permitting the owner of said carrying bag to retain a grasp of said carrying means.

6 Claims, 5 Drawing Figures

ANTI-THEFT CARRYING BAG

BACKGROUND OF THE INVENTION

This invention relates to carrying bags such as handbags and shoulder bags as usually carried by women and consisting of a carrying means such as a handle or strap member attached to a container member. More particularly, the present invention relates to said carrying bags provided with an anti-theft means associated with said carrying means.

Commonly used carrying bags generally consist of a carrying strap or handle attached to a container member. One variety, having a short carrying strap, is held by hand by said strap, and is known as a handbag. Another variety, having a longer strap which is worn over the shoulder, is known as a shoulder bag. It is not an uncommon occurrence for women to be victimized by purse-snatchers who, with a very rapid and forceful movement, will sieze a carrying bag in a manner so as to sever the owner's grasp of it, and then run off with said carrying bag. Numerous techniques have already been explored to thwart the purse-snatcher's efforts. Most of the known approaches involve the use of alarm systems, or tether lines wound onto a spring-activated reel contained within the container member, said line being connected at its free end to the owner, or the owner's clothing. Such reeled line mechanisms are disclosed for example in U.S. Pat. Nos. 539,842; 2,783,926; and 3,126,598.

Although alarm systems occasionally deter theft, activation of the alarm at the proper instant is not assured, and such activation generally occurs after the actual theft. Also, alarm systems do not provide positive restraint means or means for retrieval of the taken carrying bag. Problems associated with carrying bags attached by a line to the person or clothing of the owner include the inconvenience in using the bag, safety hazards engendered by the tether line, the possibility of torn or damaged clothing, loss of space in the container member by virtue of the space occupied by the line-holding reel, and the possibility of malfunction if the reel is unable to deploy line at a rate commensurate with the speed of motion of the purse-snatcher. The inertial effects of rotating reel mechanisms are such as to either provide a definite drag on the deploying line, or overreact to cause spilling and consequent tangling of the line.

It is accordingly an object of the present invention to provide a carrying bag having anti-theft means which does not attach said carrying bag to the clothing or person of the owner, and which does not occupy space in the container portion of said carrying bag. It is another object to provide a carrying bag comprised of a container member and carrying means, said carrying means being provided with an anti-theft means which affords positive restraint to thwart a would-be purse-snatcher. It is still a further object of the present invention to provide a positive-restraint anti-theft means for a carrying bag without utilization of a rotating reel or other moving parts which impart inertial resistance to the rapid deployment of a line. Other objects and advantages will become apparent hereinafter.

SUMMARY OF THE INVENTION

The objects of the present invention are accomplished in general by providing a carrying bag comprising carrying means attached to a container member, said carrying means being provided with at least one anti-theft means comprising an elongated tubular housing, a length of thin, strong line stored in a rapidly deployable configuration within said housing, a removable closure means engaged with at least one end of said housing, said closure means being attached to said carrying means and to said line.

In a preferred embodiment, the tubular housing also serves as the handle for a handbag and is centrally associated with the carrying means of the handbag so that equal lengths of strap or equivalent structure connect each end of the anti-theft means to the container member of said handbag.

DETAILED DESCRIPTION OF THE INVENTION

Figure 1:
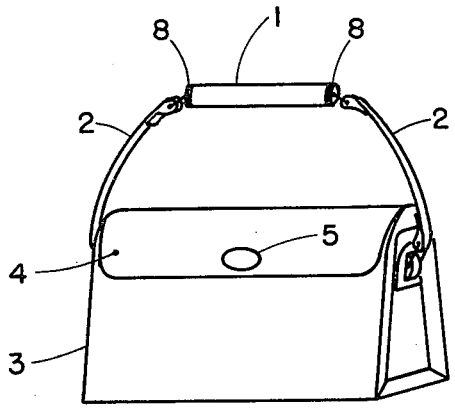
FIG. 1 is a perspective view of a handbag of the present invention corporating anti-theft device 1 containing two closure means 8.

Referring to the accompanying drawings, FIG. 1 illustrates a handbag embodiment of carrying bag comprising anti-theft device 1 connected at each end to strap members 2 which extend from said anti-theft device and attach to container 3. The container 3, in the preferred embodiment illustrated in FIG. 1 is designed to be reasonably flat and have a shape generally elongated in the horizontal direction, namely the direction parallel to the long axis of the anti-theft device when the handbag is being carried by the owner. Container members of such design are convenient to use and cause minimum interference with the normal activities of the user. The container may be rigid or non-rigid, and may be a bag, box or other suitable confining structure.

A sealing means 4 is provided, usually at the uppermost portion of the container 3. The sealing means of FIG. 1 is a flap provided with a fastening device 5. However, alternative to a flap, other equivalent sealing means may be utilized, such as zippers, buttons, snaps, magnetic devices, Velcro (a fibrous enmeshing substrate made by the Velcro Corp., N.Y.) and the like. The function of the sealing means is merely to provide facile opening and closing of the container member.

Figure 2:
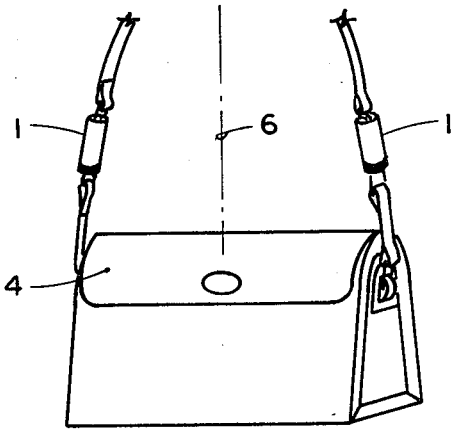
FIG. 2 is a perspective view of a shoulder bag of the present invention with the upper part of the carrying strap not shown, incorporating two anti-theft devices 1.

The strap members 2 engage with the container 3 at an upper region thereof, the sites of attachment being symmetrically disposed about the center axis 6 of the carrying bag, and usually located near the extremities of said container. In the case of the handbag as shown in FIG. 1, the anti-theft device 1 also serves as the handle or grip by which the carrying bag is held by the user. In the case of a shoulder bag, as illustrated in FIG. 2, two anti-theft devices are associated with the strap members, and are symmetrically disposed about the center axis 6.

Figure 3:
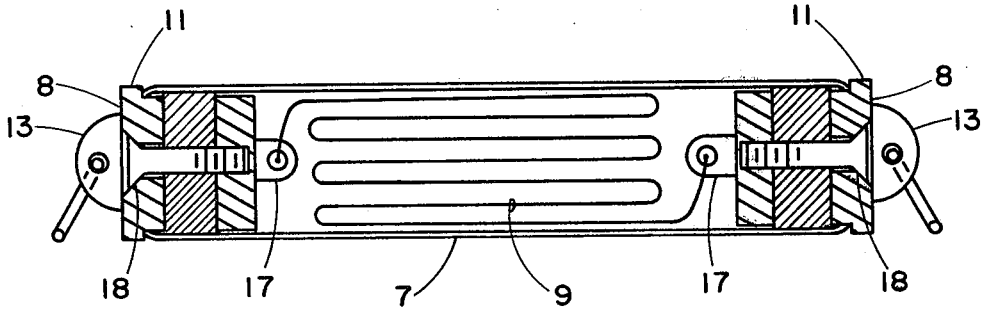
FIG. 3 is a sectional view of the anti-theft device of FIG. 1 taken along its longitudinal axis.

The anti-theft device shown in FIG. 3 consists of an elongated tubular housing 7, retaining plug closure means 8 engaging with the ends of said housing, and a length of deployable line 9 attached at each end to an interior attaching means such as the apertured tabs 17 associated with each of the retaining plugs 8.

The tubular housing 7 preferably has a circular cross-sectional configuration having a diameter between about ½ inch and 1½ inches, although other configurations are also useful. The housing may be a right circular cylinder, or it may taper to a smaller diameter at each end in the manner of a bilaterally truncated elipsoid or prolate spheroid. In any event, the housing is an elongated form preferably possessing a rotational axis of symmetry in the direction of elongation, and a plane of symmetry perpendicular to the direction of elongation at the midpoint of the length of said housing. In a particularly preferred embodiment, the tubular housing is a right circular cylinder crimped on each end.

The tubular housing is fabricated from strong, rigid material such as metal, plastics or the equivalent. It is preferable that the wall thickness of the housing be as thin as possible so as to envelope the maximum possible internal volume consistant with acceptable strength of the housing member. In terms of the volume of empty space encompassed by the housing relative to its wall thickness, it may be stated that the volume of empty space should represent between about 50% and 90% of the total solid volume the housing would occupy if it were solid. The housing may consist of two halves hinged together to form the desired tubular configuration. Such manner of construction facilitates insertion of the deployable line 9.

The exterior surface of the tubular housing may be suitably ornamented or given improved gripping characteristics by embossing, engraving, plating, decorative coatings, adhered materials, and other methods.

The deployable line 9 stored within the tubular housing is a thin, high tenacity strand having a breaking strength of at least 40 pounds. The line may be a monofilament or multi-filament strand, and may be fabricated of materials such as steel, nylon, polyester, rayon, fiberglass, polypropylene, or other materials capable of forming thin strands having high tensile strength.

At least 20 feet, and as much as 60 feet of length of said line is stored within the tubular housing member. The manner of storage of the line is important because it must be capable of rapidly emerging from the housing with minimum resistance in an essentially tangle-free condition. One manner of storage is in the form of a coil-type winding about the longitudinal center axis of the housing. Such winding may either be made on a core which rests within the housing, or the winding may be self-supporting, having no core. In windings devoid of a core, the line may unwind from either the inside or the outside of the winding. Unwinding from the center is preferable because this mode avoids frictional interaction of the deploying line with the inside wall of the housing member. Coreless windings can be made on collapsible, removable cores which can be removed once the winding is in place within the housing. Such windings can also be made in two joined and continuous sections in a manner such that line can simultaneously unwind from each end from the interior of the winding.

Another type of winding useful in the practice of the present invention is one wherein the line is essentially stacked or coiled in a manner such that the portion of line closest to the end of the tubular housing is first to be removed, with the last portion of line positioned close to the midpoint of the housing member. In such coils, each successive turn of line lies adjacent to the previous turn. In this respect, stacked windings are different than the usual type of strand windings as in spools, reels or bobbins which utilize a traverse pattern causing the strand to cross over all other strand windings in a back-and-forth manner. Such conventional windings are designed to permit unwinding in a tangential manner in a direction perpendicular to the rotational axis of said spool or bobbin. In the present invention, however, unwinding is carried out in a direction perpendicular to the winding and coaxial with the core or longitudinal center axis of the winding. Stacked, non-traversed windings can be made with the aid of an outer shell which keeps the strand in place until the complete strand package or winding is formed.

A particularly preferred manner of line storage comprises non-wound, folded configurations. In one such embodiment, the line may be placed in uniform long folds extending the length of the housing and coaxial therewith, as illustrated in FIG. 3. Such manner of line storage is similar to methods utilized in parachutes, where rapid and reliable deployment of lines and straps is vital. Another mode of folded line storage may utilize random folds in a plane perpendicular to the longitudinal axis of the housing member. Such manner of line storage is employed in the synthetic fiber industries for the packaging of bales of continuous strand material which can be unwound without tangling. It is sometimes referred to as a "piddled" or piled package. Lines having such manner of storage can be inserted into the housing member by stuffing techniques.

Figure 4:
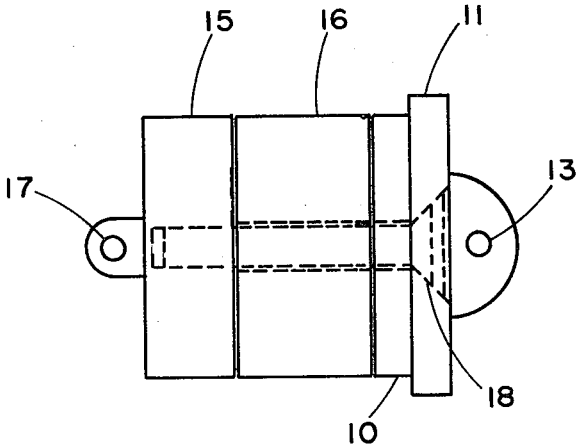
FIG. 4 is a side elevational view of the closure means of FIG. 3.
Figure 5:
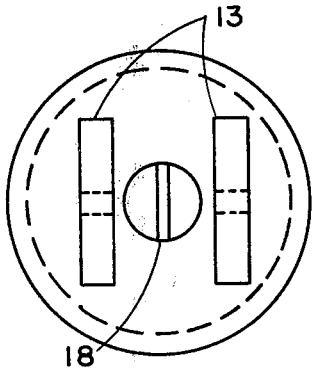
FIG. 5 is an elevational end view of the closure means of FIG. 4.

The retaining plug 8 shown in FIG. 4 has a forward portion 10 which fits within the tubular housing, and a flange 11 which abuts against the end of said housing. A bolt 18 threaded at one end extends axially through said plug and engages with locking washer 15. The turning of bolt 18 causes the washer 15 to press tightly onto the resilient ring 16, causing the resilient ring to engage more forcefully with the inside wall of the housing, thereby providing frictional retention of the plug 8 by the housing 7. Interior apertured tab 17 is provided in association with the washer 15 to provide a means for attachment of the stored line 9. Exterior attaching means in the form of a pair of external apertured tabs 13 symmetrically placed in opposing relationship about the head of bolt 18 serves as a means for attaching plug 8 to the straps 2 of the carrying bag. In the case of a shoulder-type carrying bag, as illustrated in FIG. 2, each anti-theft device need contain only one plug or closure member.

Other means may also be employed whereby the tightness of fit of said plug within said housing may be suitably adjusted. One such other means, for example, may employ two split or half rings which can be urged into more forceful contact with the inside wall of the housing by means of an eccentric cam mounted on a shaft which extends through the plug to its outer surface.

In operation, the user of the carrying bag of the present invention provided with adjustably fitting plug closure means on the anti-theft device will adjust the tension on the plugs to the point where the weight of the container member and its contents is insufficient to pull the plugs from the housing member. However, when a greater stress is suddenly placed on the carrying means leading to the anti-theft device, the closure plugs separate from the housing and rapidly deploy the stored line. Since the user will still have a grasp of either the handle of FIG. 1 or shoulder strap of FIG. 2, the container member can be retrieved. The time during which the line deploys gives the victim of the purse-snatcher sufficient opportunity to respond to the unexpected and sudden action of the purse-snatcher; and the line itself provides the means to retrieve the container member of the carrying bag.

Alternative to the use of closure means such as plugs whose tightness of fit within the housing can be adjusted, there may be employed closure means equipped with shear pins in a manner such that a force significantly greater than the weight of the container and its contents will sever the shear pins, causing release of the closure means and attendant deployment of the stored line.

Although the closure means should resist removal by virtue of the weight of the container member and its contents, the force required to remove the closure means from the tubular housing should not be excessive because it could cause the user to lose her grasp of the handle of a handbag when the purse-snatcher exerts a sudden force on same. It has been found, however, that when the weight required to remove the closures is between 125% and 200% of the weight of the container and its contents, the closure means will resist accidental removal, and will release before the owner loses her grasp of a handle.

What is claimed is:

1. In a carrying bag comprising a container and carrying means therefor, the improvement comprising an anti-theft device associated with said carrying means, said anti-theft device comprising a tubular housing, a line stored in a rapidly deployable configuration within said housing, closure means engaged with at least one end of said housing, said closure means being attached to both an end of said line and said container, said closure means being removable from said housing by a force exceeding the weight of said container and its contents.

2. The carrying bag of claim 1 wherein said tubular housing is cylindrical and inwardly crimped on each end, and wherein said closure means frictionally engages with the inside wall of said housing, the magnitude of said frictional engagement being adjustable.

3. The carrying bag of claim 2 wherein said carrying bag is a handbag.

4. The handbag of claim 3 wherein the extent of frictional engagement of said closure means with the inside wall of said housing is accomplished by means of application of compressive force to a resilient member positioned within said housing.

5. The handbag of claim 4 wherein said closure means contains interior attaching means for said line, and exterior attaching means for said container.

6. The handbag of claim 4 wherein said line is stored in a folded configuration.

* * * * *